United States Patent [19]

Foerster

[11] Patent Number: 4,613,196

[45] Date of Patent: Sep. 23, 1986

[54] TELEPHONE CORD TERMINATING PLUG

[75] Inventor: Gerhard Foerster, Woodbridge, Conn.

[73] Assignee: Jane G. Montgomery, Woodbridge, Conn.

[21] Appl. No.: 494,542

[22] Filed: May 13, 1983

[51] Int. Cl.[4] ..... H01R 11/20

[52] U.S. Cl. ..... 339/97 P; 339/103 M; 339/176 M

[58] Field of Search ..... 339/97 R, 97 P, 98, 339/99 R, 176 M, 103 M

[56] References Cited

U.S. PATENT DOCUMENTS

| | | | |
|---|---|---|---|
| 2,647,245 | 7/1953 | Gilbert | 339/99 R |
| 3,668,301 | 6/1972 | Faulconer | 339/97 R |
| 4,062,616 | 12/1977 | Shaffer et al. | 339/99 R |
| 4,211,462 | 7/1980 | Wolfthal | 339/97 R |
| 4,262,984 | 4/1981 | Takahashi | 339/99 R |
| 4,265,505 | 5/1981 | Bourdon | 339/99 R |
| 4,315,663 | 2/1982 | Olsson | 339/97 P |
| 4,444,449 | 4/1984 | Aysta et al. | 339/99 R |

*Primary Examiner*—Gil Weidenfeld
*Assistant Examiner*—Thomas M. Kline
*Attorney, Agent, or Firm*—Prutzman, Kalb, Chilton & Alix

[57] ABSTRACT

An improved electrical connector for terminating a low current multi-wire telephone cord of the like is comprised of a one piece dielectric housing having a cord receiving aperture with a plurality of terminal receiving slots extending between the aperture and a first or top exterior surface of the connector. The connector includes a recess operatively associated with the slots and extending from the aperture toward the exterior surface of the connector opposite the first or top exterior surface. Individual terminal blades of simplified configuration are positioned within the slots and have a wire contact portion adapted to pass through the longitudinal plane of the aperture into the recess. As the terminals are pressed into the housing for making electrical contact with the wires of the cord, they engage the wires of the cord and bend the wires out of the plane of the aperture and into the recess while simultaneously providing the requisite electrical contact. This positively locks the individual wires in place within the connector at each terminal making it virtually impossible to separate the cord from the connector even when the jacket of the cord of the insulative covering on the wire is not firmly anchored. The structure provides both a positive electrical connection between the terminal and the wire core and a secure mechanical interlock between the terminal, the wire and the housing of the connector plug.

11 Claims, 3 Drawing Figures

TELEPHONE CORD TERMINATING PLUG

BACKGROUND AND SUMMARY OF THE INVENTION

The present invention relates generally to an electrical connector for low current devices, such as cord terminating and connecting plugs for telephones and the like. More particularly, it is concerned with a new and improved one-piece modular plug for terminating multi-wire telephone cords.

Modular type terminal plugs of the type described are now being used extensively in the telephone industry as a rapid and easy means of providing the requisite interconnection between a base and hand set of a telephone, between the base and wall terminal block of such units and between wall blocks and other components of the system. The plugs are mounted on both ends of a length of multi-wire telephone cordage and are operatively secured thereto. The plugs may then be cooperatively received within receptacles or jacks in the various telephone units to accurately align the contacts connected to the wires in the plug with mating terminals within the various components of the system. A typical example of a connecting plug used in this manner can be found in the Hardesty U.S. Pat. No. 3,860,316 and other examples can be found in the patents mentioned therein. Although many of these plugs utilize two or more separate plug housing portions that are bonded together at the time of assembly, the aforementioned Hardesty patent discloses the advantages associated with making and using a one-piece modular connector. Accordingly, the disclosure therein is incorporated herein by reference.

In the Hardesty structure thin blade-like contacts or terminals having sharply pointed tangs are mounted within the dielectric housing of the connector in a side by side array with the pointed tangs driven through the tinsel or stranded core of each wire in the telephone cord for making a suitable electrical connection. However, if a tang is slightly bent it can completely miss the wire core or undesirably shear a portion or all of its tinsel core. As a result, problems can be experienced in maintaining the desired and necessary electrical continuity between the connected units. Additionally, since the pointed tangs preferably pierce the wire in such a way that the tang is aligned along the axial length of the wire. There is the possibility that the wire could be pulled through the tang and completely out of the plug during use. This can be a problem particularly where flat telephone cord is employed and the jacket of the cord is not firmly anchored within the plug.

Additionally, regulations and codes frequently require that the individual wires, particularly solid wires within the telephone cord must be specially treated, such as with a teflon insulation or coating in order to permit use of the cord within certain areas of a building. Unfortunately, such treatments substantially increase the cost of the telephone installation. Accordingly, the industry has been seeking all available means of lowering the cost of the remaining components, such as the terminal plugs, so as to reduce the entire cost of the installation while complying with the various codes and regulations.

The present invention advantageously provides a connector of the type described that positively locks the individual wires in place within the connector at each terminal making it virtually impossible to separate the cord from the connector, even when the jacket of the cord or the insulative covering on the wire is not firmly anchored. This is achieved in an economical fashion while eliminating the disadvantages associated with the pointed tangs of the terminals. At the same time there is provided both a positive electrical connection between the terminal and the wire core and a secure mechanical interlock between the terminal, the wire and the housing of the connector plug.

Other features and advantages will be in part obvious and in part pointed out more in detail hereinafter.

In accordance with the present invention, these advantages have been achieved by providing an improved electrical connector for terminating a low current multi-wire telephone cord or the like. The connector comprises a one piece dielectric housing having a cord receiving aperture with a plurality of terminal receiving slots extending between the aperture and a first or top exterior surface of the connector. The connector includes a recess operatively associated with the slots and extending from the aperture toward the exterior surface of the connector opposite the first or top exterior surface. Individual terminal blades of simplified configuration are positioned within the slots and have a wire contact portion adapted to pass through the longitudinal plane of the aperture into the recess. As the terminals are pressed into the housing for making electrical contact with the wires of the cord, they engage the wires of the cord and bend the wires out of the plane of the aperture and into the recess while simultaneously providing the requisite electrical contact.

The invention accordingly consists in the features of construction, combination of elements and arrangement of parts which will be exemplified in the construction hereafter set forth in the detailed disclosure.

DETAILED DESCRIPTION

Figure 3:
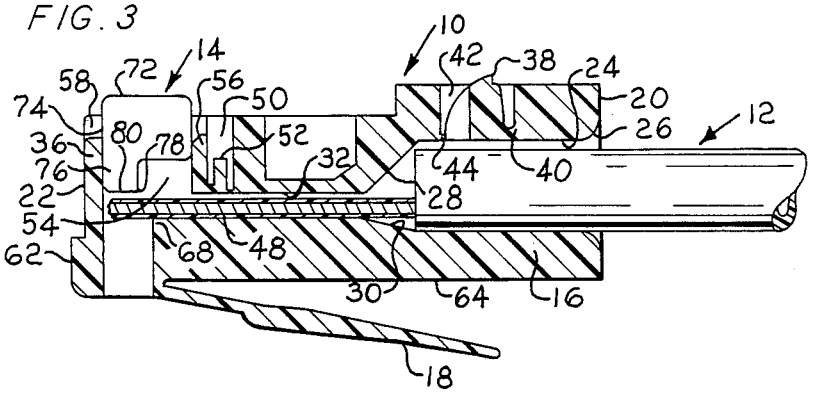

Referring now to the drawings in greater detail wherein like reference numerals indicate like parts throughout the several figures, the present invention is shown as embodied within a one piece modular connector 10 of the telephone plug type. As will be appreciated, the one piece modular plug may be designed so as to accommodate multi-wire telephone cords of different construction, such as flat or round cords having four, six, eight, or more solid, stranded or tinsel core wires. The plug illustrated in the drawings is one that will accommodate an eight-wire round cord, such as the cord 12 shown in FIG. 3. As molded, the plug is completely formed and no further assembly or bonding is required since the unit is designed as a unitary single piece member requiring no additional component other than the separate blade-like metal terminals 14 mounted thereon. The plug 10 comprises a generally rectangular housing portion 16 and an integral depending locking tab portion 18 which, for clarity of description, will be referred to as extending generally rearwardly from the bottom of the housing adjacent the forward or front end thereof. The plug is designed to be easily molded using conventional injection molding techniques so as to result in a rigid dielectric member of one piece construction that can be rapidly and economically produced in large quantities.

The elongated, generally rectangular housing portion 16 is formed with a central aperture extending longitudinally therealong from the rear wall 20 toward but stopping short of the front end or face 22 thereof. At the rear or cord receiving end of the housing, the aperture takes the form of a large cord-receiving entrance portion 24 of a size and configuration adapted to receive a fully jacketed multi-wire telephone cord 12 of the type described. The entrance portion 24 is flared at its lip 26 for receiving the cord and extends for a distance of about one-third to one-half the length of the plug. At the inner end of the entrance portion, the aperture constricts, predominantly as a result of the tapering top and bottom surfaces 28, 30 respectively, and communicatively flows directly into a relatively narrower longitudinally extending wire receiving portion 32. This narrower portion of the aperture extends toward the front face 22 of the plug terminating at the interior of the front wall 36. The aperture may be divided within this portion into a plurality of parallel elongated wire receiving slots or stations of a size that accommodates both the wire and its insulative covering. This is achieved through the use of a plurality of tooth like ridges disposed in confronting relationship in either or both the top and bottom surfaces of the aperture. The transverse array of transversely communicating, longitudinally extending channels for the individual insulated wires of the multi-wire cord has been utilized effectively heretofore whereby the conductors are restrained against unwanted lateral displacement. The channels also assure the necessary distinct separation between the wire conductors during insertion of the telephone cord into the plug and the proper alignment of those wires within the housing for engagement by the terminals. Where a flat cord is utilized and the jacket is not removed, the confronting ridges are not necessary.

The housing 16 also is provided with means for securely holding both the cord and its insulated wires after they have been mounted within the plug. This includes a cord anchoring wedge 38 integrally connected to a rear section of the plug housing through a plastic hinge 40. The cord anchoring wedge 38 is positioned within a transversely extending recess 42 in the top surface of the housing above the entrance portion 24 of the central aperture and extends transversely across a major portion of the width of the housing while leaving the opposite sides of the housing as solid stabilizing portions of the plug. The cord anchoring wedge 38 initially is connected to the housing at its forward end by a very thin web 44 of dielectric material that is readily ruptured when the wedge 38 is pressed inwardly into the central aperture. The wedge 38 is contoured, as shown, to bear against the round cord 12 or a flat cord in a well known manner to provide its cord anchoring function.

Figure 1:
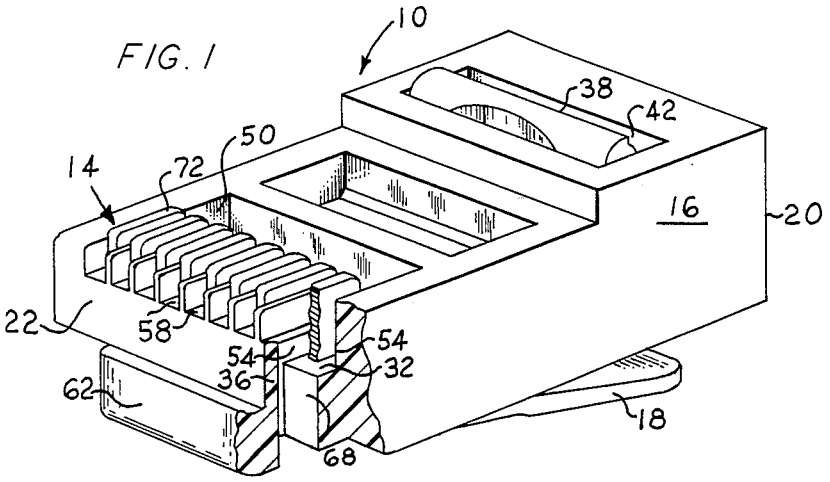
FIG. 1 is a perspective view, partially broken away, of a modular type connector plug of the present invention prior to being mounted on the end of a multi-wire telephone cord.
Figure 2:
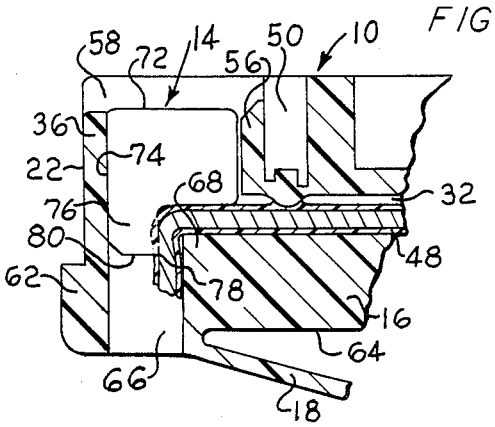
FIG. 2 is an enlarged longitudinal sectional view of the front portion of the connector plug of FIG. 1 showing a wire of a telephone cord secured within the plug and FIG. 3 is a longitudinal sectional view of the plug of FIG. 1 showing the cord inserted within the plug prior to being secured therein.

The housing 16 further is provided with a similar type of anchoring or restraining member for engaging the insulative coverings on all of the individual wires 48 located within the wire receiving portion 32 of the aperture. In this connection, the top surface of the housing has a second recess 50 that extends transversely across the center portion of the housing between the rigid sides and a wire anchoring member is provided therein in the form of a deformable restraining bar 52. The bar is spaced forwardly from the cord anchoring wedge 38 by a distance sufficient to place the bar 52 in overlying relationship with the narrow wire receiving portion 32 of the central aperture. The bar 52 is integrally connected to the remainder of the housing so as to permit it to be moved or deformed inwardly toward and into the wire receiving portion 32 of the aperture for lockably engaging each and every wire positioned therein, as illustrated in FIG. 2.

The anchoring structures are similar to the corresponding structures described in greater detail in the aforementioned Hardesty U.S. Pat. No. 3,860,316, and the disclosure therein is incorporated herein with respect to these members. As mentioned therein, these members not only independently secure the cord 12 and the multiple wires 48 carried therein, but also help to provide a strain-alleviating function on the conductors during customer usage.

Between the front face 22 of the housing and the recess 50 for the wire anchoring bar 52 there is provided a series of thin terminal receiving slots 54 extending longitudinally of the plug. The number of slots conforms to the number of wires in the cord intended for use with the plug, such as eight slots in the illustrated embodiment, and the slots 54 are disposed in a transversely spaced, aligned, parallel or side-by-side array. The slots 54 provide direct communication between the top surface of the plug and the wire receiving portion 32 of the central aperture. The width of each slot is sufficient to comfortably receive a single plate-like terminal while the length thereof is defined by the upper portion of front wall 36 of the plug and the forward wall 56 of the anchoring bar recess 50. Longitudinally extending partitions 58 are provided on the top of the plug housing between each adjacent pair of slots 54 both to separate the slots and to provide guides for the terminal contacting components of the jack operatively associated with the plug.

At the forward end of the plug the housing is provided with a mounting ledge 62 that projects forwardly of the front face 22 of the housing generally below the central aperture. A resilient locking tab portion 18 is integrally molded to the underside of the housing so that its longitudinal axis extends along that of the housing yet is oriented at an angle of approximately 15° with respect to the plane of the housing. The locking tab 18 should be of a configuration that will permit the insertion of the plug into a conventional jack whereby the tab portion is deflected toward the underside or bottom surface 64 of the housing and moves slideably into engagement with a corresponding locking surface on the jack as the ledge 62 engages the jack. The configuration and function of the locking tab is also similar to the tab described in the aforementioned Hardesty patent.

In accordance with the present invention, the forward end of the housing is provided with a trough or recess 66 adjacent the lower interior portion of the plug's front wall 36 below the wire-receiving portion 32 of the central aperture. The recess 66 extends transversely across the plug and communicates fully with the central aperture, extending downwardly through the bottom surface 64 to provide appropriate wire clearance. If desired the recess 66 may extend from the aperture toward the bottom surface of the plug to a depth approximately equal to it width. In either event, this results in a cavity having a generally L-shaped longitudinal cross section with the wire receiving portion 32 of the aperture forming a first long narrow leg of the cavity and the recess 66 forming a second short broader leg thereof. The shoulder or ledge 68 formed at the juncture of the aperture 32 and the recess 66 provides an anvil that extends transversely across the housing between the rigid sides thereof and is integrally connected thereto. The recess 66 and the anvil 68 underlie the array of terminal receiving slots 54, the anvil being of a sufficient size and strength to permit bending and shaping of the wires fully positioned within the aperture 32 when the wires are forced against the anvil by their respective blade-like terminals 14 mounted within the slots 54.

The terminal plates 14 utilized in the electrical connector of the present invention are electrically conductive metal members that take the simplified form of flat plates or sheets devoid of the protruding tangs utilized heretofore and having an L-shaped configuration. Each terminal plate 14 has a flat top edge surface 72 for engagement by a complementary conductive component of the associate jack. The top edge surface 72 is approximately equal in length to its intersecting front edge surface 74 and further is approximately equal to the size of the terminal receiving slot 54, this overall length being significantly greater than the width of the trough 66 underlying the slots. The front edge surface 74 abuts the front wall 36 of the plug housing and tends to stabilize the terminal as it moves from the pre-secured position shown in FIG. 3 to the set or secured position of FIG. 2.

The terminal plate 14 includes an operating leg portion 76 provided with an abrupt sharp rear corner edge 78 which, together with the bottom surface 80 of the leg portion 76, initially engages a wire 48 within the wire-receiving aperture 32 as the terminal 14 moves toward its set position. Initially, the terminal 14 is placed within the slot 54 so that the top edge 72 thereof extends above the dividing partitions 58 and the bottom surface 80 of the operating leg portion 76 rests well above the longitudinal plane of the wire-receiving aperture. As the terminal is pressed into the plug housing, the bottom edge surface 80 of the depending leg portion 76 bears against the insulated wire 48 overhanging the recess 66, pushing the free end of the wire into the recess 66 against the restraining action of the anvil shoulder 68. As the terminal comes into contact with the wire it initially bends the unsupported portion of the wire over the anvil shoulder. Subsequently, as resistance to the bending motion builds, due to the restraining action of the anvil, the sharp corner edge 78 cuts into and through the insulation of the wire 48 as it continues to bend, bringing it into electrical engagement with the core of the wire. The further downward movement of the terminal 14 continues to bend and cut into the wire until the remainder of the terminal's main body portion comes into engagement with the supported portion of the wire immediately above the anvil shoulder 68. This action, of course, lockably secures the bent wire against the anvil so as to provide a firm and secure mechanical interengagement between the wire, the terminal, and the plug housing. Simultaneously, the terminal plate provides a positive electrical connection between the core of the wire and the terminal plate thereby assuring electrical continuity coupled with mechanical retention. As can be appreciated, this action operates smoothly, efficiently, and effectively regardless of whether the wire has a solid, stranded or tinsel core and positively provides the desired electrical contact between the wire and the terminal. Additionally, the resistance of the wire to bending tends to push the front edge surface 74 of the terminal 14 into secure abutting engagement with the front wall 36 of the plug housing thereby firmly anchoring the terminal within the housing as the wire is mechanically wedging within the recess. In this manner, the housing, the wire, and the terminal cooperate to provide mechanical retention of all of the assembled components.

As will be apparent to persons skilled in the art, various modifications, adaptations and variations of the foregoing specific disclosure can be made without departing from the teachings of the present invention.

What is claimed is:

1. In an electrical connector for terminating an unmated free end portion of a single low current multi-wire electrical cord without the necessity for altering the length of the cord comprising a one piece dielectric housing having a central wire receiving aperture, a front wall forming a barrier at one end of the aperture, a plurality of terminal receiving slots extending between the aperture and a first exterior surface of the connector, the aperture at each slot being of a size sufficient to receive only a single wire of the multi-wire cord and individual plate-like terminals positioned within the slots for movement toward the aperture, the combination comprising an interior front wall surface having a first planar portion between the aperture and said first exterior surface defining said terminal receiving slot and a second planar portion between the aperture and a second exterior surface opposite said first exterior surface a wall structure spaced from said second planar portion and defining therewith a recess associated with each slot and extending from said aperture toward the said second exterior surface of the connector opposite said first exterior surface to provide a generally L-shaped wire-receiving cavity for receiving the free end portion of the multi-wire cord, said first and second planar portions being coplanar, said plate-like terminals being movable along said interior front wall surface from said slots toward said opposite exterior surface and having a wire engaging portion adapted to pass through the longitudinal plane of said aperture and into said recess for bending the free end portion of the wire out of the plane of said aperture and into said recess, said plate-like terminal having an elongated stabilizing front edge that bears against both said first and second planar wall surface portions and an opposite elongated edge that cuts through an insulative covering on the wire as the wire is bent into said recess whereby said wire is engageably retained between said wire engaging portion and said wall structure without significantly altering the length thereof, said wire engaging portion including means for making electrical contact with said wire along said opposite elongated edge as said stabilizing front edge bears against both said first and second planar portions of said front wall to maintain said electrical contact.

2. The electrical connector of claim 1 wherein said recess underlies at least a portion of each slot and the housing is provided with an anvil shoulder for supporting a wire in alignment with each slot for cooperative interlocking engagement between said terminal, and said anvil shoulder when said wire is positioned in said cavity.

3. The electrical connector of claim 1 wherein the recess communicates fully with both the wire receiving aperture and said terminal-receiving slots, the juncture of said aperture and recess forming an anvil shoulder for cooperating with the wire to restrain removal of the wire from the cavity of the connector.

4. The electrical connector of claim 1 wherein said means for making electrical contact includes a corner edge of a terminal adapted to slidably engage the wire to make electrical contact therewith.

5. The electrical connector of claim 1 wherein said terminal is a planar member having an L-shaped configuration.

6. The electrical connector of claim 1 wherein the recess underlies at least a portion of terminal receiving each slot and communicates fully with both the wire-receiving aperture and the terminal-receiving slot, the juncture of said aperture and recess forming an anvil shoulder for supporting a separate wire having a free end in alignment with each slot and for cooperating with the terminal in each slot to hold the free end of each wire in the cavity of the connector.

7. The electrical connector of claim 1 wherein said means for making electrical contact including a sharp corner edge of a terminal adapted to penetrate the wire to make electrical contact therewith.

8. An electrical connector for terminating an unmated free end portion of a single low current multi-wire electrical cord without the necessity for altering the length thereof comprising a generally rectangular one piece dielectric housing having top and bottom surfaces and front and rear walls on the longitudinal ends thereof, a central cord receiving aperture extending longitudinally through the housing from said rear wall toward said front wall, an array of terminal receiving slots adjacent the front wall and extending between the aperture and the top surface of the housing, said aperture at each slot adjacent said front wall being of a size sufficient to receive only one wire of a single multi-wire cord, a transverse recess underlying at least a portion of said slots within said array and having a recess defining wall spaced from said front wall and extending from said aperture toward the bottom surface of the housing to provide with said longitudinal aperture a wire-receiving cavity having a generally L-shaped longitudinal cross-section and anvil shoulder for supporting the free ends of the individual wires of the cord, said front wall forming a front end barrier for longitudinally terminating said aperture and having an interior surface with a first planar portion defining said slots and a second coplanar portion defining said recess, a plurality of individual plate-like terminals positioned within the slots for movement along said first planar portion toward the cavity, said terminals having a wire engaging portion adapted to pass through the longitudinal plane of said aperture and into said recess for bending the entire free end portion of the wires of said cord out of said aperture about said anvil shoulder and into said recess, said plate-like terminal having an elongated stabilizing front edge that bears against both said first and second planar portions and an opposite elongated edge that cuts through an insulative covering on the wire as the wire is bent into said recess whereby said wire is engageably retained between said wire engaging portion and said recess defining wall without significantly altering the length thereof, said wire engaging portion making electrical contact with the wire as the wire is bent into said recess, said stabilizing front edge bearing against both said first and second planar portions of said front wall to maintain said electrical contact.

9. The electrical connector of claim 8 wherein said terminals include a wire-confining portion adapted to operatively cooperate with the anvil shoulder to securably engage a portion of the wire positioned within the aperture at said anvil shoulder and resist removal of the wire from said cavity.

10. The electrical connector of claim 8 wherein the slots within said array are disposed in parallel side-by-side relationship and extend longitudinally of the housing in overlying relationship to said cavity and said anvil shoulder.

11. The electrical connector of claim 8 wherein said terminal is a planar member having an L-shaped configuration adapted to cooperate with the anvil shoulder to confinably retain the wire within the L-shaped cavity.

* * * * *